US005653678A

United States Patent [19]

Fulk

[11] Patent Number: 5,653,678

[45] Date of Patent: Aug. 5, 1997

[54] APPARATUS FOR TREATING CARPAL TUNNEL SYNDROME

[75] Inventor: Paul F. Fulk, W. Carrollton, Ohio

[73] Assignee: Paratech Industries, Inc.,, Dayton, Ohio

[21] Appl. No.: 411,212

[22] Filed: Mar. 27, 1995

Related U.S. Application Data

[63] Continuation-in-part of Ser. No. 113,369, Aug. 30, 1993, which is a continuation-in-part of Ser. No. 989,698, Dec. 14, 1992, abandoned.

[51] Int. Cl.[6] ..... A61H 1/00

[52] U.S. Cl. ..... 601/33; 601/5; 601/26; 602/36; 606/241

[58] Field of Search ..... 482/44; 602/21, 602/32–36; 606/241; 601/98, 100, 5, 26, 101, 105, 33, 40; 128/878, 774, 782, 898; 73/379.01

[56] References Cited

U.S. PATENT DOCUMENTS

| | | | |
|---|---|---|---|
| 3,937,216 | 2/1976 | Brown | 602/32 |
| 5,181,904 | 1/1993 | Cook et al. | 602/32 |
| 5,217,488 | 6/1993 | Wu | 606/241 |

FOREIGN PATENT DOCUMENTS

| | | | |
|---|---|---|---|
| 479688 | 4/1992 | European Pat. Off. | 128/774 |
| 1510717 | 1/1968 | France | 601/40 |
| 2597749 | 10/1987 | France | 601/34 |
| 9002543 | 3/1990 | WIPO | 601/5 |

*Primary Examiner*—Jeanne M. Clark
*Attorney, Agent, or Firm*—William Weigl

[57] ABSTRACT

An apparatus for relieving symptoms of carpal tunnel syndrome includes restraining the elbow of the patient from movement while applying a controllable tension to the wrist in a direction away from the elbow. The apparatus further includes a mechanism for rotating the wrist while the forearm is under tension.

24 Claims, 11 Drawing Sheets

APPARATUS FOR TREATING CARPAL TUNNEL SYNDROME

RELATED U.S. PATENT APPLICATION DATA

This application is a continuation-in-part of my similarly-entitled application Ser. No. 08/113,369 filed Aug. 30, 1993, which in turn was a continuation-in-part of my application Ser. No. 07/989,698, filed Dec. 14, 1992, now abandoned.

The present invention relates to the treatment of hand disorders and, more particularly, to a method and apparatus for relieving hand disorders due to carpal tunnel syndrome.

BACKGROUND OF THE INVENTION

In recent years, a medical problem formerly described as wrist level median nerve entrapment, but now commonly referred to as carpal tunnel syndrome (CTS) has taken on an ever-increasing significance, particularly in monetary payouts by states for worker's compensation claims and by insurance companies for claims related to CTS surgery. People have reported having aggravated symptoms of weakness and clumsiness in hand functions, often accompanied by pains that shoot up the arm from the wrist. Sensations such as tingling and intermittent numbness of the thumb, index finger and the middle and radial part of the ring finger are the most common symptoms. Workers that are at risk for carpal tunnel syndrome due to repetitive tasks include computer operators, typists, stenographers, garment workers, seamstresses, chiropractors, masseurs, butchers, packers, assembly line workers, tennis players, golfers and others involved in activities where the impact and twisting of the forearm and hand result in injury.

The common treatment by physicians has been the prescription of diuretics, injection of steroid drugs, use of a splint at night, and, if all else failed to provide relief, ultimately surgery. In the chiropractic field, the common treatment has been to grip the patient's elbow in one hand, take the other hand near the wrist, apply a slight twist and perform a quick outward jerk on the wrist. The action would be repeated several times, but it had limitations in effectiveness. Not only is this a strenuous activity for the chiropractor, but it is difficult to apply and maintain even pressure for anything but a moment with each manipulation. And, in particular, this manual technique is incapable of providing and maintaining a controllable steady pressure at a level which can differ from patient to patient due to sex, age, strength and other factors.

SUMMARY OF THE INVENTION

There is provided, in accordance with the present invention, a method and apparatus for use in the treatment of carpal tunnel syndrome which includes a support member on which the forearm of the patient is positioned. The elbow of the arm is held in a restrained position on the support member. The wrist is connected by means of strap members in the form of a harness with reins to a pneumatic actuator or traction device. Upon operation of the actuator, outward pressure is exerted and maintained between the elbow and hand by a steady pulling or tugging on the harness under a predetermined force for a predetermined time period. The force is such that the actual pressure is essentially against the base of the hand where the hand merges with the wrist. The resulting extension of the arm and the wrist causes a reduction in the compression of the carpal tunnel ligament upon the median nerve in the wrist relieving the pressure on the nerve. Control means is provided for determining the amount and duration of the pressure applied to the wrist. The system is designed for operation by a trained therapist, however, the patient also has the option of immediately stopping the application of pressure if suffering any discomfort. The harness and reins are oriented to both pull and rotate the arm and wrist, the latter preferably occurring during the extension of the arm.

It is therefore a principal object of the present invention to provide a method and apparatus for relieving the symptoms of carpal tunnel syndrome, and in particular, for avoiding, minimizing or delaying the need for CTS surgery.

Another object of the present invention is to provide such an apparatus with the capability of direct patient interruption of its operation during treatment.

It is a further object of the present invention to provide such an apparatus in which the amount and duration of the force used to relieve the symptoms of carpal tunnel syndrome is controllable.

A further object is to provide an apparatus capable of simultaneously applying both tension and torsion between the elbow and wrist.

It is yet another object of the present invention to provide an apparatus for use in the treatment of carpal tunnel syndrome which is simple in construction and low in cost.

Other objects and advantages will become apparent from the accompanying drawings and description.

BRIEF DESCRIPTION OF THE DRAWINGS

Additional advantages and meritorious features of the present invention will become more apparent and fully understood from a reading of the following detailed description and appended claims when read in conjunction with the drawings, wherein like reference numerals indicate like or corresponding elements throughout the several views and wherein:

DETAILED DESCRIPTION OF THE PREFERRED EMBODIMENT

Figure 1:
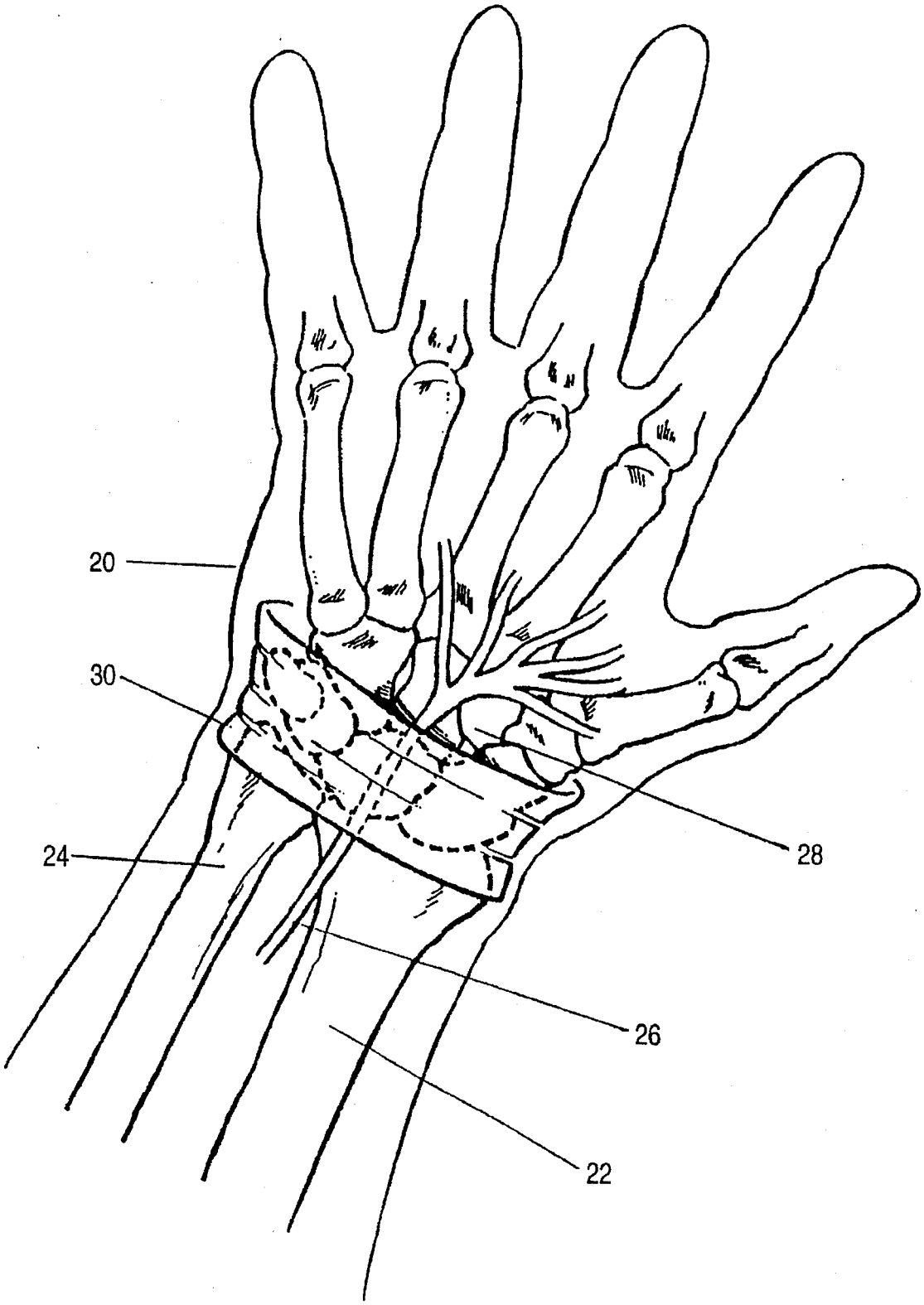
FIG. 1 is a representation of the human hand and wrist showing the location of the elements which are subject to carpal tunnel syndrome.

Referring now to FIG. 1, there is shown a schematic representation of the hand and wrist area of the arm indicated generally by the numeral 20. It includes the end portions of the radius bone 22 and the ulnar bone 24, both of which extend along the forearm 23 to the elbow. As they extend toward the elbow, the radius and ulnar bones overlap each other (not shown). Extending along the arm and between the radius bone and the ulnar bone and into the hand is the median nerve member 26. Positioned at the base of the hand in the wrist area are eight carpal bones 28 arranged to form a groove through which the median nerve extends. Surrounding the carpal bones on three sides is the palmar carpal ligament 30 forming a tunnel with the carpal bones. The tunnel contains tissue surrounding the median nerve 26.

Repetitive motion of the forearm and hand together with the impact of the hand or fingers on the keyboard of a computer or any other surface with which the hand comes into contact results in the application of a slight torque to the radius and ulnar bones, resulting in the proximal compression and repositioning of the radius and ulnar bones. This action results in tissue inflation, causing the tissue to expand, and also tightens the transverse palmar carpal ligament 30 about the carpal bones 28. Together, the swollen tissue expansion and the ligament contraction causes compression of the median nerve 26. The pressure on and pinching of the nerve 26 produces the affliction now called CTS.

Figure 2:
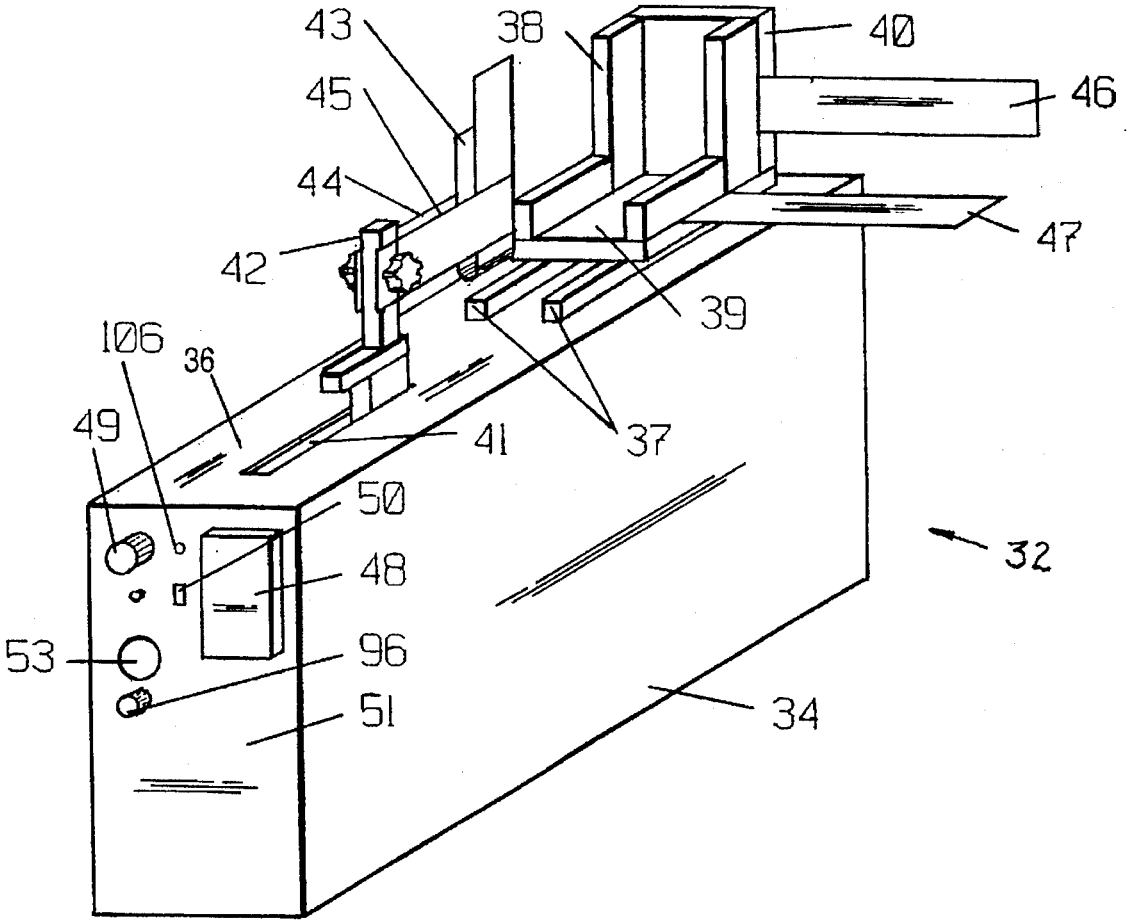
FIG. 2 is a top front oblique view of the system used in the treatment of car tunnel syndrome, showing the location of the arm support member, the straps for securing the arm and the elbow to the arm support member and the harness and reins for connecting the wrist to the wrist drive member.

Referring now to FIG. 2, there is shown a top front oblique view of the apparatus or therapy device of the present invention generally indicated by the numeral 32. The device 32 includes a housing member 34 having a top surface 36 on which a pair of rail members 37 and an arm support member 38 is mounted. The support member 38 comprises a horizontally-extending forearm support portion 39 and a vertically-extending back portion 40 that will be described more fully hereinafter. Extending upwardly through an aperture 41 in the surface 36 is a wrist drive member in the form of a vertical post 42 to which is attached a pair of strap members or reins 44 and 45. The reins 44, 45 are attached to and support the sides of a strap member or harness 43. The harness 43 is a band which can be wrapped around the wrist tightly, and includes a fastener product sold under the registered trademark Velcro of American Velcro Inc. The harness 43 is fitted around and encircles the wrist of a patient whose forearm and elbow are resting on the support portion 39. The inner skin-contacting surface of the harness contains a frictional sponge material for gripping the wrist and preventing relative wrist and harness rotation. As will be described more fully hereinafter, the elbow is secured to the support member, preferably also by means of Velcro strap members 46, 47. Upon forward movement of the post 42, the wrist will be distracted from the elbow, relieving the compression of the palmar carpal ligament 30 (FIG. 1) upon the median nerve 26.

Figure 7:
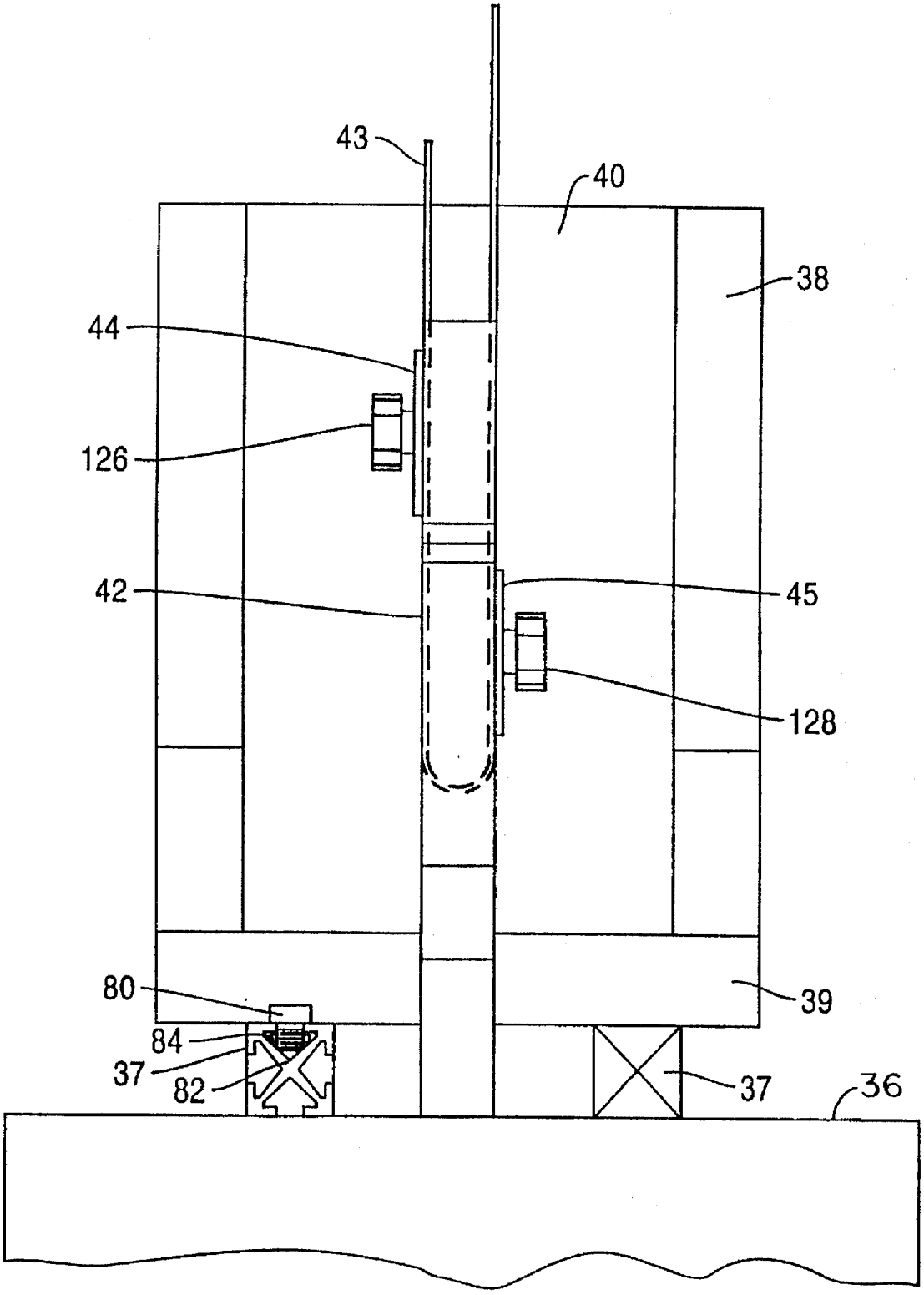
FIG. 7 is an enlarged partial frontal view of the arm support member and drive member, with a fragmentary cross-sectional portion of one of the extruded rail members showing the locking members for locking the arm support member in an adjusted position.
Figure 10:
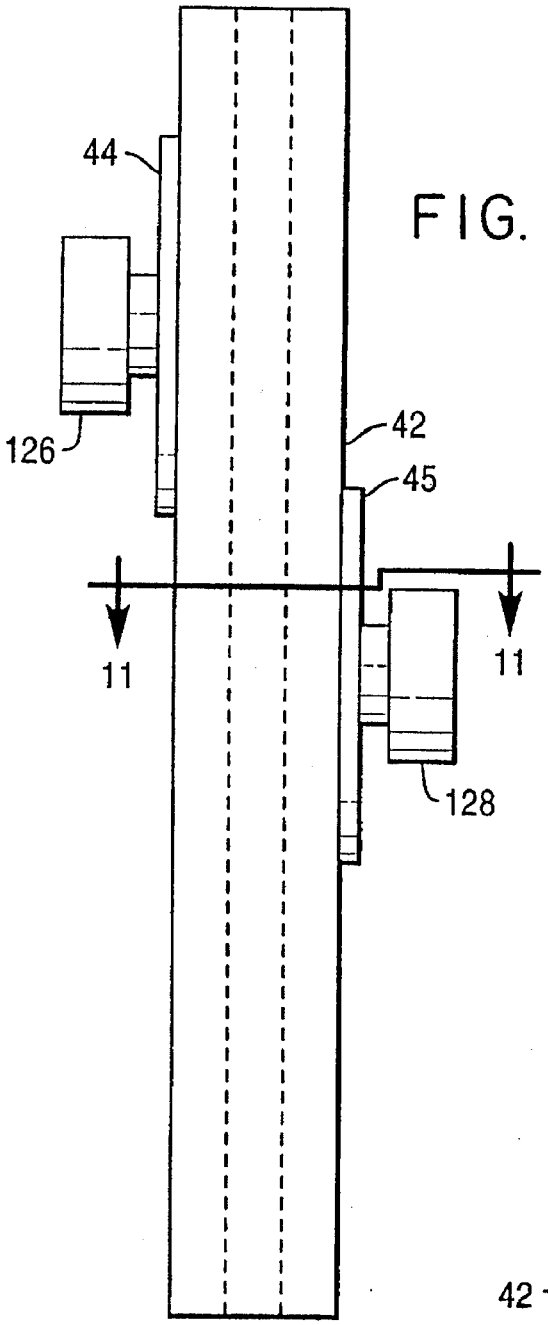
FIG. 10 is a partial front view of the wrist drive member showing ends of the reins positioned on the wrist drive member to effect simultaneous rotation of the arm and wrist during their extension.

A protocol developed for use of the apparatus includes placing the harness 43 about the wrist with the palm of the hand facing upwardly and the reins 44, 45 being horizontal. The ends of the reins remote from the harness 43 are then attached to the post 42 at the same level. In this mode, the post 42 is driven away from the elbow for ten time periods of five seconds each, with a relaxation of the pressure for five seconds between each pull. Upon completion of this rectilinear pull, the ends of the reins connected to the post are then offset vertically, first to the right for ten pulls and relaxations and subsequently to the left for ten similar actions. As best shown in FIGS. 7 and 10, the ends of the reins 44 and 45, which were originally attached at the same level during the initial ten pulls, are now fastened to the post 42 in vertically-offset fashion. This effects a twisting or torsional motion on the wrist and forearm during the distraction, so that both tension and torsion are applied simultaneously. Preferably, the therapist will initially determine by known techniques whether the forearm is stronger in a right or left twisting direction. This is typically done by testing the opponens muscles in known fashion. The second set of ten pulls will rotate the wrist in the direction toward the weakest side of the forearm and the third set toward the strong side.

Mounted on the front panel 51 of the housing member 34 is a standard intervalometer member 48 for setting the time period during which pressure is applied to the drive member 42, a manual regulator knob 96 for controlling the amount of pressure applied to a pneumatic actuator 58 (FIG. 3), a pressure gauge 53 indicating the amount of pressure being applied to the actuator 58 an emergency stop button 49, a power indicator 106 and a compressor cut-off switch 50.

Figure 3:
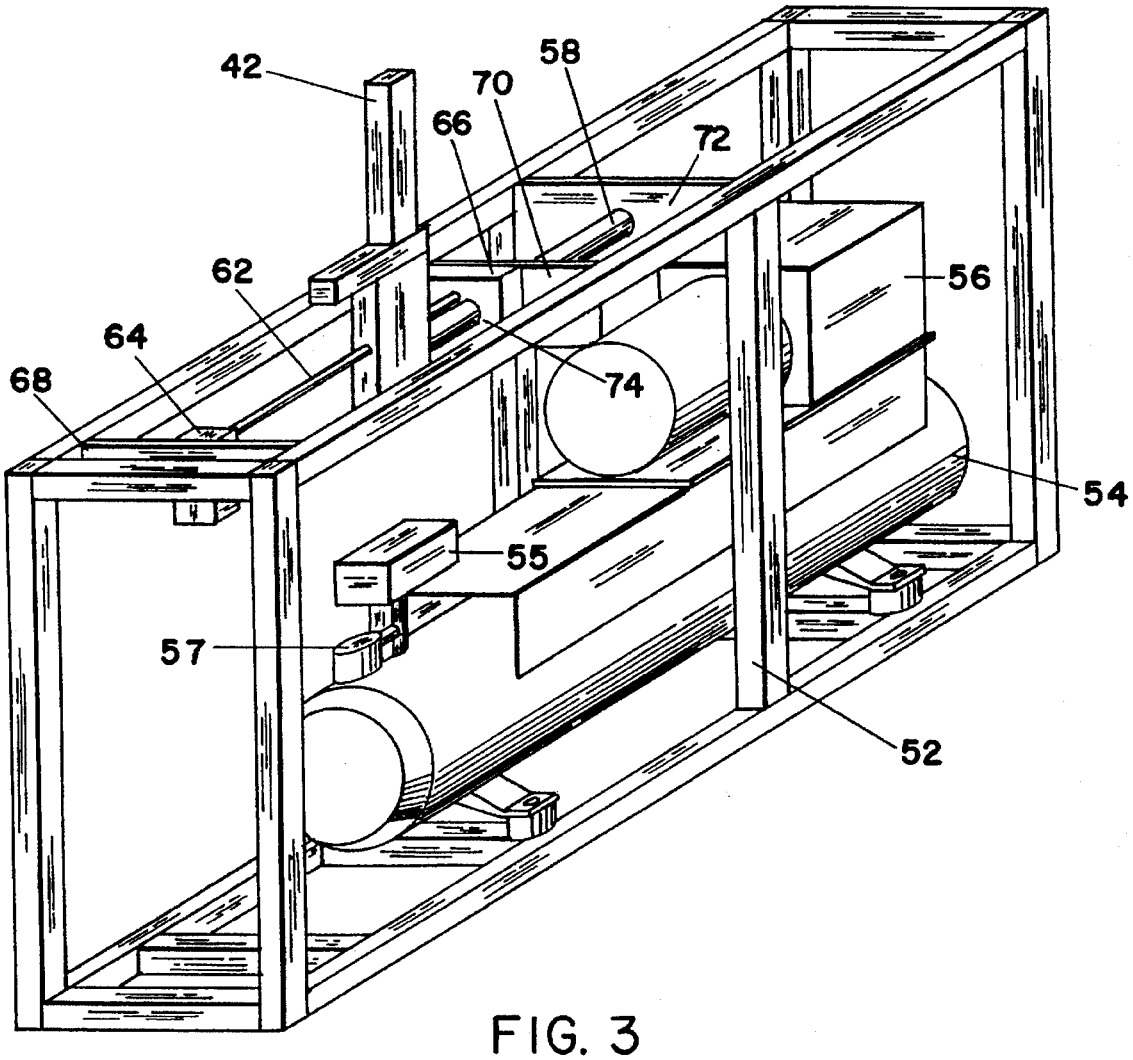
FIG. 3 is a view similar to FIG. 2 with the housing removed to illustrate the pneumatic elements which form the drive system for actuating the wrist drive member.
Figure 4:
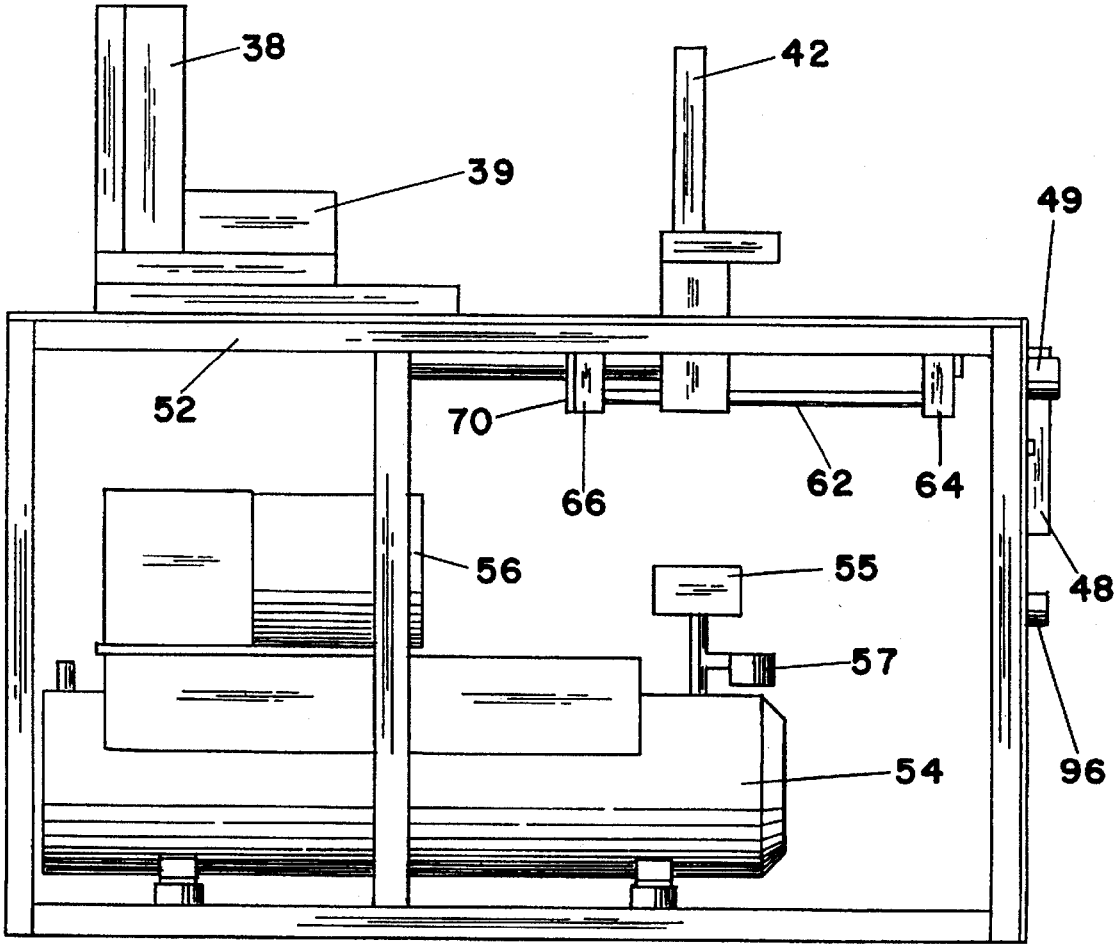
FIG. 4 is a view of the system taken from the far side of FIG. 3.
Figure 5:
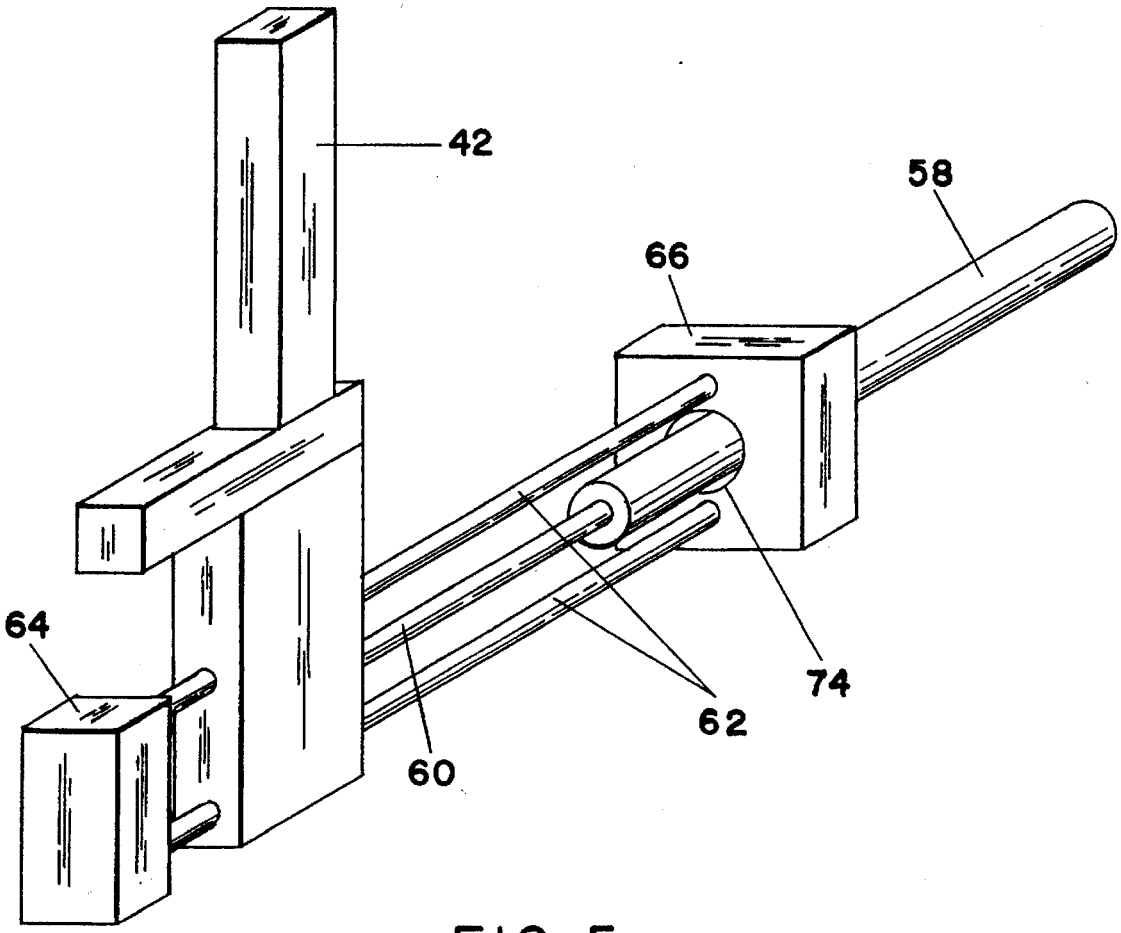
FIG. 5 is an enlarged top front oblique view of the actuator system for driving the wrist drive member.
Figure 6:
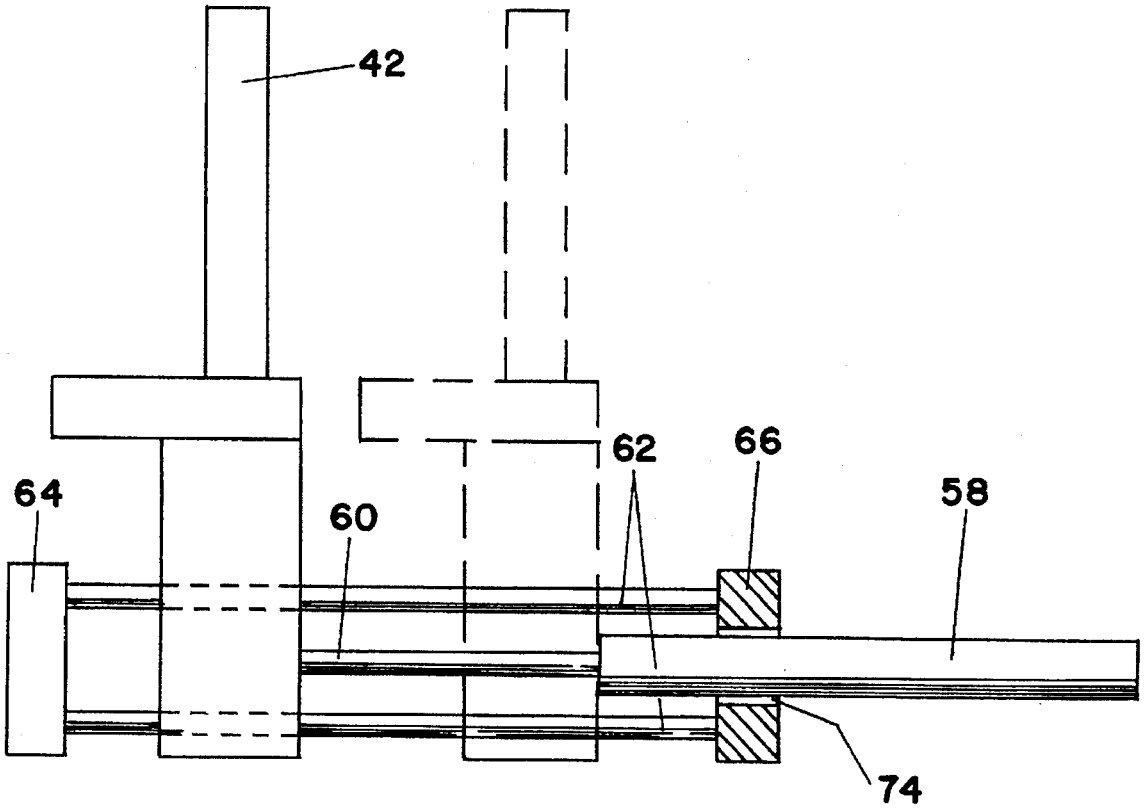
FIG. 6 is a side view of the actuator system shown in FIG. 5, illustrating the extent of movement of the wrist drive member by the actuator member.

Referring now to FIGS. 3 and 5, there is shown a top front oblique view of the apparatus with its outer walls removed. The apparatus includes a box-like tubular aluminum frame structure 52 within which is mounted a 120–125 pound psi air tank 54, an air compressor 56 for supplying air to the tank 54 and the pneumatic actuator 58. The actuator 58 includes a piston rod 60 (FIG. 6) one end of which engages the drive member or post 42. Mounted to the air tank 54 is a pressure switch 55 and an air pressure gauge 57 indicating the pressure of air in the tank 54. As best seen in FIGS. 4, 5 and 6, the post 42 is slidably mounted on a pair of support rod members 62. The rod members 62 are mounted between a pair of depending support members 64 and 66, which in turn are secured to a pair of cross-frame members 68 and 70 respectively (FIG. 3). The piston rod 60 is mounted between a cross-frame member 72 and the frame member 70 and is positioned within an aperture 74 in the support member 66. FIG. 6 illustrates the maximum length of travel of the post 42 by the piston rod 60 upon operation of the actuator 58. The amount of extension of the post 42 is dependent on the location of the elbow on the arm support member 38 at the start of the operation of the actuator 58 and the horizontal movement of the post 42 away from the elbow. The dotted-line position of the post 42 in FIG. 6 is the initial set-up position in which the relaxed arm and wrist are first secured in the arm support member 38 while it is free of the housing member 34. The member 38 is then moved in the direction of toward the elbow and locked to the housing in that position with little or no tension in the reins 44, 45. The depiction of post 42 in its solid line position is the maximum extension away from the elbow, but such position is not reached, since it would prevent the set pressure in the wrist and arm from being achieved. The pneumatic actuator is designed to pull on the harness only until the preset controlled pressure has been reached, and go no further. One such actuator is a band cylinder manufactured by Tol-O-Matic, Inc. of Minneapolis, Minn.

Referring now to FIG. 7, there is shown an enlarged front view of the arm support member 38 with an end portion of a rail member 37 removed to show details of the locking members for slidably locking the arm support member 38 to the rail members 37. Mounted on the arm support member 38 is a screw member 80 having a threaded end which extends into a V-shaped recessed portion 82 of the rail member 37. Secured to the threaded end of the screw member is a nut member 84 which, upon rotation of the screw member 80, will be drawn up against the top edge of the recessed portion 82 of the rail member 37 and lock the arm support member 38 to the rail member 37. Also shown in FIG. 7 are a pair of screw members 126 and 128 which are slidably mounted for vertical adjustment along the post 42. The members 126 and 128 releasably attach the reins 44 and 45 for independent vertical adjustment relative to the post 42. This difference in elevation as seen in FIGS. 7 and 10 causes the wrist and arm to rotate in either a clockwise or counterclockwise direction, toward whichever one of the screw members is lowermost. As will be described more fully hereinafter, the mounting of the screw members 126 and 128 within the post 42 may be the same as the mounting of the screw member 80 within the rail member 37.

Figure 8:
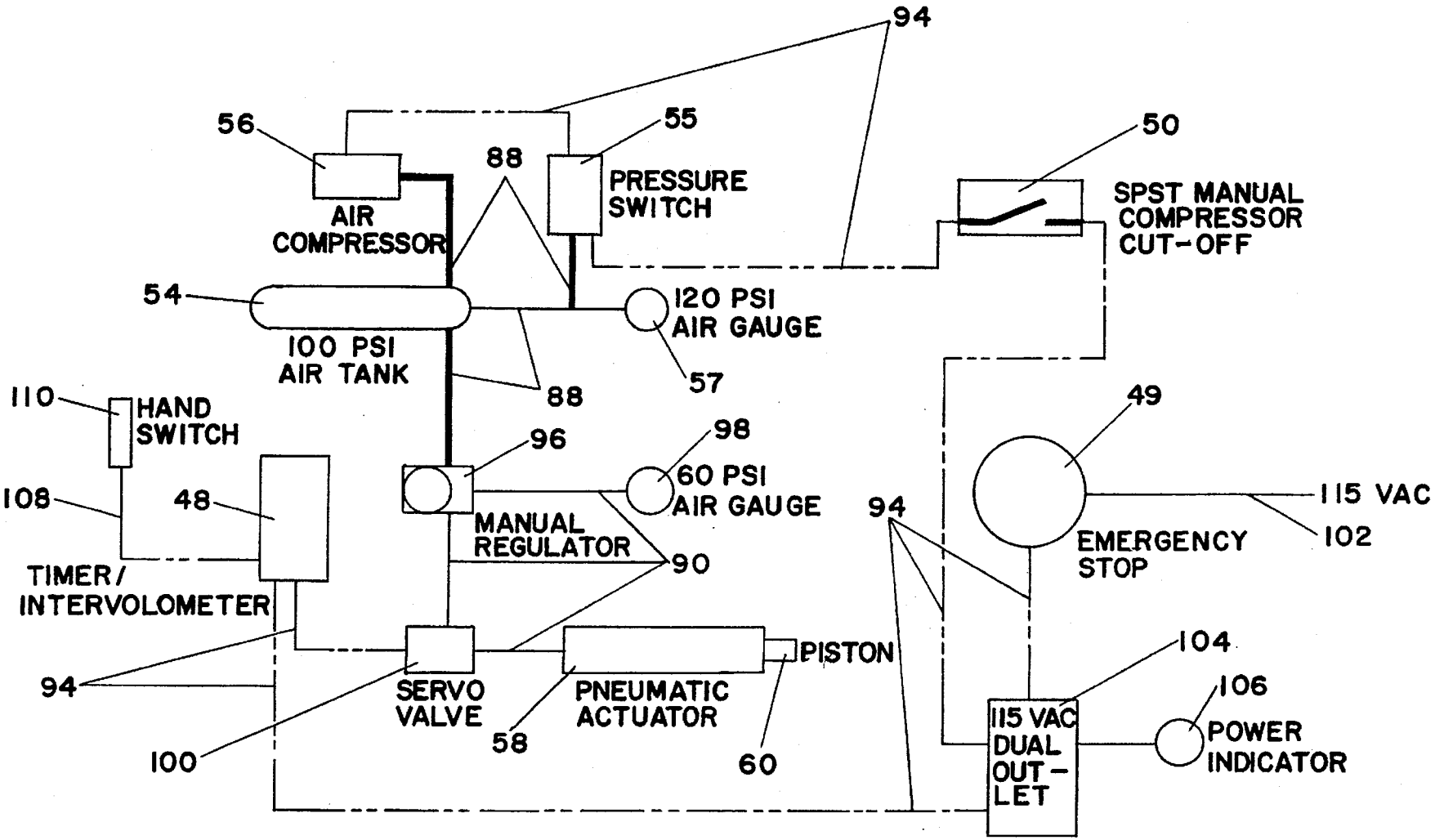
FIG. 8 is a schematic representation of the drive systems for operating the pneumatic actuator, and the electrical circuit for controlling the operation of the pneumatic drive systems.

Referring now to FIG. 8, there is disclosed a schematic representation of the drive systems used to control the operation of the pneumatic actuator 58 for moving the post 42 in a direction away from the elbow. Included in the drive systems is a high pressure line system represented by lines 88, a low pressure line system indicated by the lines 90 and a 115 V. AC electrical circuit indicated by the dot-dash lines 94.

Included in the high pressure system is the air compressor 56, the air tank 54 which is normally maintained at a pressure of 120 pounds psi, the pressure switch 55 which senses the pressure in the tank 54 and operates the compressor 56 when the pressure in the tank reaches 60 pounds psi and the 100 pounds psi air gauge 57 which indicates the pressure level in the tank. Included in the low pressure system is the manually-operated pressure regulator 96 connected to an air pressure gauge 98 and a servo valve 100. When operated, the regulator 96 regulates the pressure from the tank 54 to the level indicated on the gauge 98 which normally in the present invention is 40–60 pounds psi. The servo valve 100 is connected to the pneumatic actuator 58 and controls the amount of air pressure applied to the actuator 58. Normal starting pressure for men is 60 pounds psi; for women, 40 pounds psi. The pressure is adjusted up or down as required to fit the needs of particular patients. The electrical circuit system includes a 115 V. AC voltage source appearing on line 102 to the emergency stop button 49 located on the front panel 51 of the housing member 34 (FIG. 2). The stop button 49 is electrically connected to a 115 V. AC dual outlet box 104 which is connected to a power indicator 106, the intervalometer 48 (FIGS. 2 and 9) and the manual compressor cut-off switch 50 (FIG. 2). The cut-off switch 50 is electrically connected to the pressure switch 55 (FIG. 3) which in turn is connected to the compressor 56. Actuation of the cut-off switch 50 will disable the pressure switch and the operation of the compressor 56. The intervalometer 48 is electrically connected to the servo valve 100. Connected to the intervalometer 48 is a cut-off switch 110 (FIG. 10) which is readily and easily accessible for operation by the patient. The switch 110 allows the patient to disable the pressure being applied to the wrist by actuation of the switch, enabling the servo valve 100 to relieve the air pressure being applied to the piston rod 60 and therethrough to the harness 43.

Figure 9:
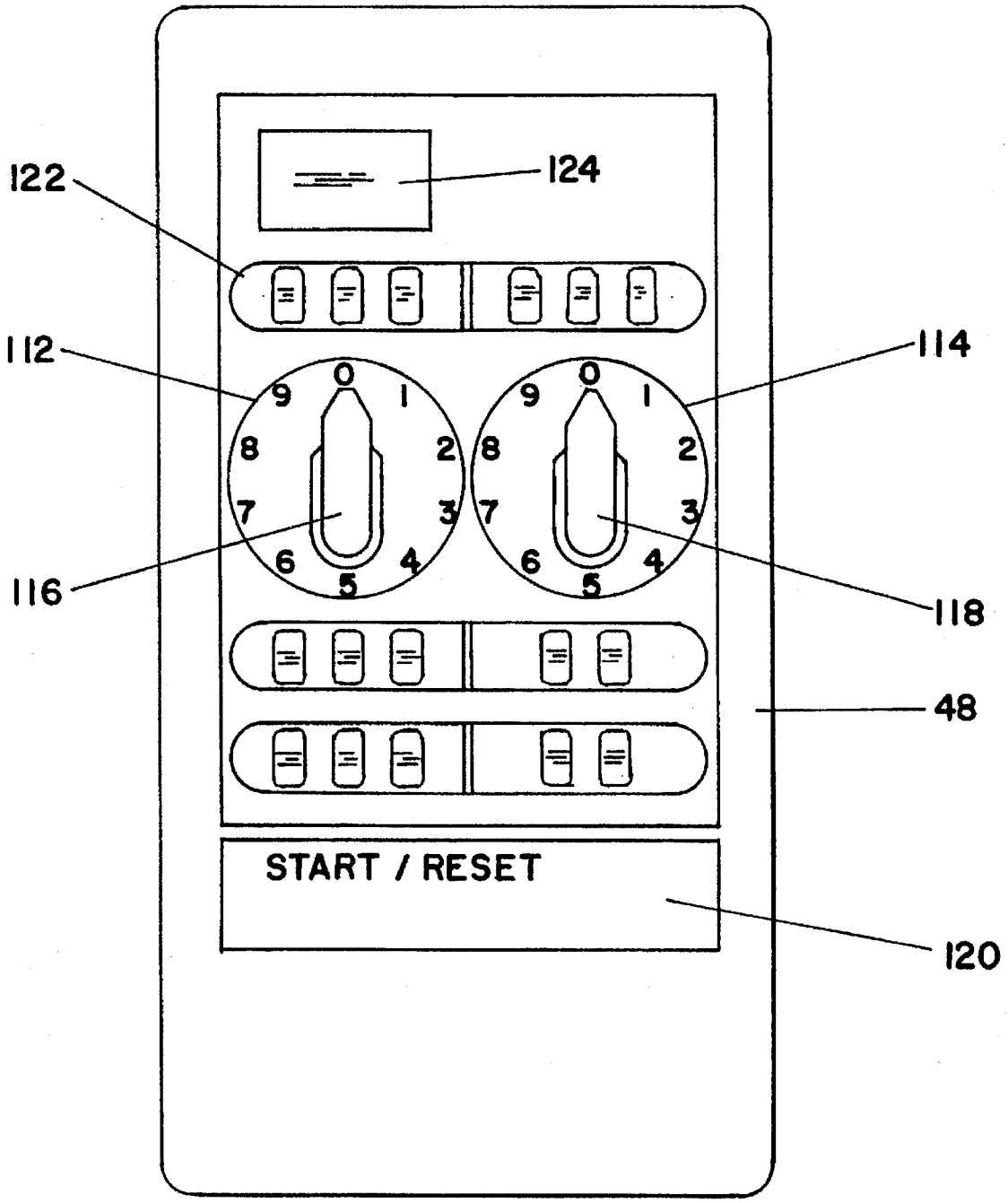
FIG. 9 is a front view of the typical intervalometer showing the means for timing of the drive period of the wrist drive member.

Referring to FIG. 9, there is shown a plan view of the intervalometer 48 (FIGS. 2 and 8) which may be of any standard construction. One example of a commercially available intervalometer that may be used is the GraLab 451 manufactured by the Dimco-Gray Co. of Centerville, Ohio. The intervalometer includes a pair of dial members 112 and 114 including pointers 116 and 118 respectively for setting the time interval during which pressure is to be applied to the wrist and a start/reset bar 120 for starting and resetting operation of the apparatus. Control buttons 122 determine seconds of operation while the displays 124 indicate the time interval selected.

Figure 11:
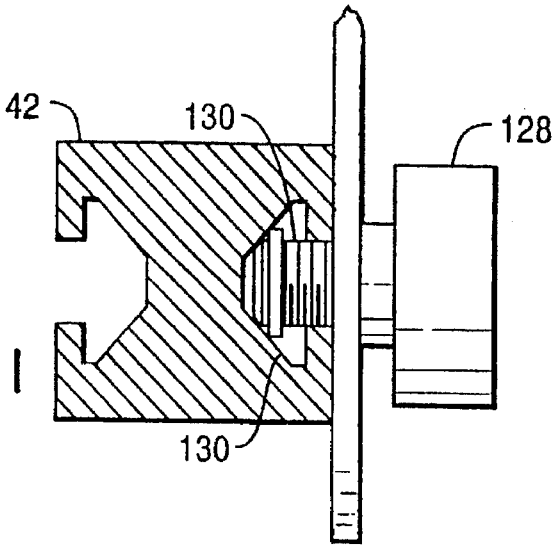
FIG. 11 is a sectional view taken along lines 11—11 of FIG. 10, showing details of the screw members used to mount the ends of the reins to the wrist drive member.

Referring now to FIG. 10, there is shown an enlarged partial front view of the wrist drive member or post 42 comprised of a rail member similar to the rail member 37 (FIG. 7) and which may include a V-shaped recessed portion 130 (FIG. 11) extending along the length of the rail member. The threaded end 132 of a screw member 128 cooperates with a nut member 134 located within the recessed portion 130 to releasably lock the rein 45 in any selected vertical location. Upon rotation of the screw member 128, the nut member 134 is drawn up against the outer edge surface of the recessed portion 103, locking the rein 45 to the post 42 in known fashion. It will be seen from this arrangement that the screw members 126 and 128 can easily be shifted along the surface of the drive member 42 to arrange the reins 44 and 45 at the same level to apply a straight pull to the harness 43, or at different levels to apply a clockwise or counterclockwise rotation or torsion to the wrist and forearm during operation of the drive member 42 if so required. In addition, depending on the cross-sectional dimension of the patient's wrist, vertical adjustment may be required even where the reins are at the same level for a straight pull, in order to align the reins with the forearm. The amount of vertical offset when both tension and torsion are to be applied is dependent on the particular patient, and whether the torsion is to be directed to the patient's weak or strong side.

In the operation of the apparatus, the patient will be in a sitting position on a chair (not shown) adjacent the housing member 34. The post 42 will be in the dotted-line (relaxed) position of FIG. 6, i.e., toward the hand, and the arm support 38 will be free to slide on rail members 37. After securing the elbow via strapping the forearm and bicep to the support member 38, the reins 44 and 45 are positioned to provide either a straight rectilinear pull or to rotate the wrist and forearm in a selected direction. The harness 43 (FIG. 2) is then used to anchor the wrist of the patient to the post 42 with the forearm positioned on the support portion 39 of the member 38. The support member 38 is manually adjusted away from the post 42 and locked to the rails 37 when the slack is removed from the reins 44, 45. The operator will turn on the apparatus by pushing in the emergency stop button 49 (FIG. 2) resulting in electrical current being applied to the compressor 56 through the pressure switch 55, the cut-off switch 50 and the dual outlet box 104 (FIG. 8). The compressor 56 will fill the tank 54 with compressed air until the pressure gauge 53 indicates a pressure level of approximately 90 pounds psi, at which time the pressure switch 55 will operate to disable the compressor 56. The operator will then select the amount of pressure to be applied by operating the manual regulator knob 96 (FIGS. 2 and 8) and setting the time interval that is to be applied to the actuator 58. The time interval is determined by selectively rotating the dial pointers 116 and 118 (FIG. 9). Starting the operation results from depressing the start/reset bar 120 on the intervalometer 48.

The intervalometer 48 will operate the servo valve 100, allowing air to be supplied to the actuator 58 and resulting in the movement of the piston rod 60. The piston rod will move the post 42 (FIGS. 2–6 inclusive) in a direction which applies pulling tension to the wrist by means of reins 44, 45 and harness 43 (FIG. 2). The resulting extension and/or extension and rotation of the arm and wrist causes a reduction in the compression of the palmar carpal tunnel ligament in the manner previously described. The servo valve 100 is of the double-acting type which, in one position, will allow air to be supplied to the actuator 58 and hold the air pressure at a constant level, and in a second position will relieve the air in the actuator. The piston rod 60 may be spring loaded and return to its home position once the air pressure in the actuator is released or may be air-actuated in both directions. If during the application of pressure to the wrist the patient experiences any discomfort, the patient can operate the switch 110 (shown schematically only in FIG. 8) to disable the timer operation and enable the servo valve 100 to relieve the air pressure being applied to the actuator 58. If an emergency arises where it is necessary to disable the operation of the post 42, depressing the stop button 49 (FIGS. 2 and 8) will disrupt the electrical circuit 94, disabling the actuator 58.

Figure 12:
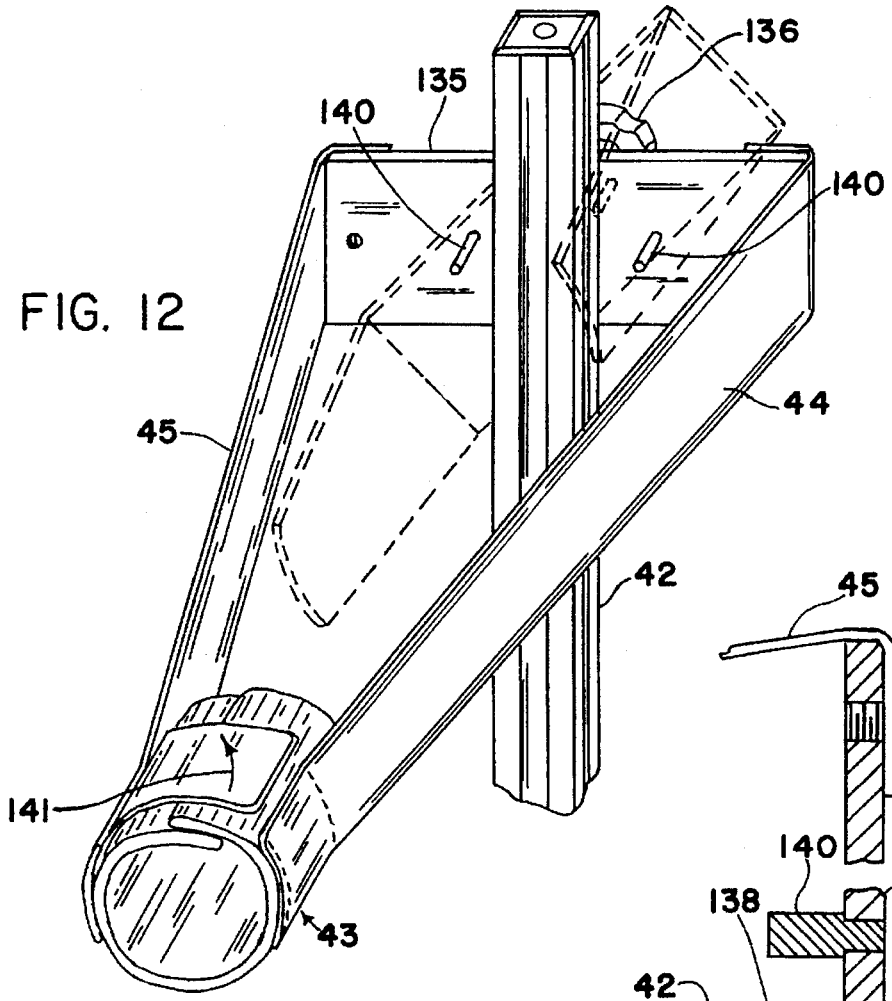
FIG. 12 is an isometric view of the harness, reins and post to which the reins are connected, illustrating another embodiment of the means for applying either tension alone, or a combination of tension and torsion while distracting the wrist and forearm.
Figure 13:
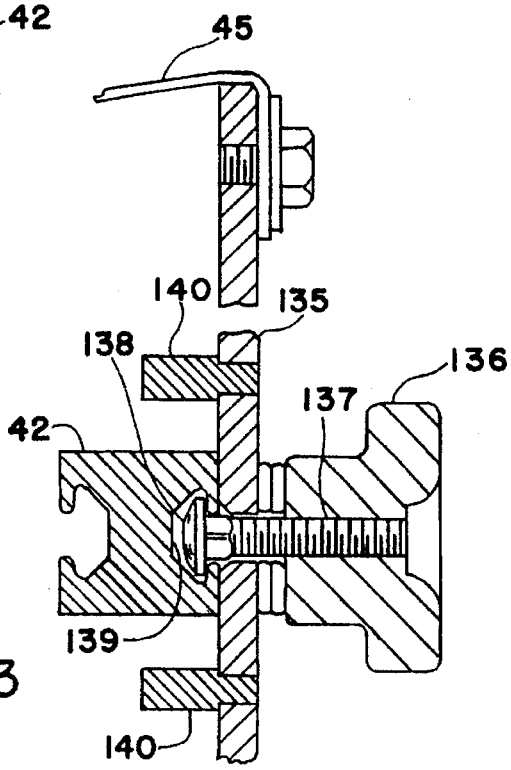
FIG. 13 is a fragmentary cross-sectional view of the post and rein-attaching cross-bar of the embodiment of FIG. 12, similar to the depiction of the embodiment shown in FIG. 11.

FIGS. 12 and 13 illustrate an improved embodiment for providing wrist and arm rotation during the distraction. A cross-bar 135 is releasably fastened to the post 42 by means of a threaded knob 136. A screw 137 has a head portion 138 in a recessed slot portion 139, passes outwardly from the post 42 and is clampable to the post 42 to prevent rotation of the cross-bar from a fixed, clamped position. In solid lines in FIG. 12, the cross-bar 135 is shown forming a "T" with post 42, i.e., it extends essentially perpendicularly to the post. The cross-bar length is approximately six inches, so as to spread the points of attachment of the reins further outwardly from the post than in the FIGS. 10 and 11 embodiment. This spacing provides for greater effectiveness of the application of torque to the harness. When the cross-bar is arranged as shown in full lines, a straight or non-rotational pull will result. If the knob 136 is turned to unclamp the cross-bar, the cross-bar may be turned in either a clockwise or counterclockwise direction. It has been rotated counterclockwise as viewed in dotted lines in FIG. 12, until stop pins 140 in the cross-bar 135 contact the post 42. Thereafter, a combined tensional and torsional force will be applied to the harness 43 during distraction, as indicated by the arrow 141 in FIG. 12. The arrow 141 will follow the direction toward the lowermost of the points of attachment of the reins 44, 45 to the cross-bar 135. If cross-bar 135 had been rotated clockwise, the arrow would be directed opposite to what is shown. Obviously, for certain patients in which only a small amount of torsion is desired, the cross-bar may be clamped in a location intermediate to the ends of its travel as limited by the stop pins 140. It can thus be seen that there has been provided by the present invention a method and apparatus which will effectively supply selected levels of pressure to the wrist of a patient relieving symptoms of carpal tunnel syndrome.

Although the presently preferred embodiment of the invention has been described, it will be understood that various changes may be made within the scope of the appended claims. While two relatively simple forms of obtaining torsion are shown, it is also considered to be within the scope of the claims to rotate the cross-bar 135 after the post 42 has already been extended. In essence, while the preferred form of the invention contemplates a simple structure for simultaneously applying both tension and torsion, it would be considered within the skill of an artisan to first apply tension and subsequently apply torsion independently, after distraction.

Having described my invention, I claim:

1. An apparatus for treating a patient for symptoms of carpal tunnel syndrome comprising:

an elongated housing having a top surface;

an elongated support member mounted above said top surface for supporting a seated patient's forearm in a generally horizontal position;

means mounted on said support member for restraining the elbow of the patient from movement in a generally rectilinear direction on said support member;

a drive member adjacent and spaced a short distance from one end of said elongated support member and being adapted for rectilinear movement toward and away from said one end of said support member;

harness means connected to the drive member;

said harness means being constructed to encircle and be firmly fastened to the wrist of the patient;

drive means within said housing engaging the drive member for moving the drive member under controllable pressure in a rectilinear direction toward and away from the elbow; and, a pair of reins interconnecting said harness means to said drive means and extending generally in the direction of said support member, the ends of said reins connected to said drive member being vertically offset, whereby, upon said drive means moving the wrist and hand away from the elbow, a combined tension and torsional force are simultaneously applied to the patient's wrist and forearm.

2. An apparatus according to claim 1 wherein said drive member comprises a vertical post attached to said drive means and wherein a slotted aperture is provided in said top surface in the direction of movement of said drive means whereby to accommodate travel of said post.

3. An apparatus according to claim 2 wherein a horizontal cross-bar is centrally pivotally mounted to said post generally at the level of said support member and wherein said reins are connected to opposing ends of said cross-bar, and releasable lock means for positioning said cross-bar either perpendicularly or angularly in either direction relative to the cross-bar, perpendicular positioning effecting a non-rotational pull on said harness means and angular positioning effecting both pull and torsion in said harness means in a direction toward the lowest end of said cross-bar.

4. An apparatus according to claim 3 wherein at least one stop pin is provided in said cross-bar spaced from the side of said post, said stop pin being engageable with said post when said cross-bar is positioned angularly in either direction so as to limit the extent of angular movement of the cross-bar.

5. An apparatus according to claim 1 wherein said drive member comprises a vertical post and wherein the ends of said reins are attached to opposite sides of said post by a clamping member at each side of said post, each clamping member having means for enabling attachment of the reins to said post at different vertical heights.

6. A therapy device for relieving carpal tunnel syndrome pain from the wrist of a patient comprising;

a housing having a top surface including a slotted aperture;

a pair of rail members secured to said top surface adjacent said aperture;

a cradle member adjustably mounted on said rail members for supporting the forearm and elbow of the patient in a generally horizontal position, said cradle member having side portions for preventing lateral movement of the forearm and elbow relative thereto;

means for securing said cradle member to said rail members in accordance with the length of a patient's forearm;

first means secured to the cradle member for restraining the elbow from movement in a generally rectilinear direction;

a rectilinearly-movable drive member mounted for movement along said aperture and extending from a first relaxed position adjacent said cradle member to a second tension-producing position remote therefrom;

second means secured to said drive member for connecting the wrist of the patient to the drive member;

actuating means in said housing for operating said drive member under controlled-pressure movement thereof in a direction away from the elbow to distract the forearm and wrist; and, means interconnecting said second means to said drive member to effect rotation of the wrist and forearm during such distraction.

7. An apparatus according to claim 6 wherein said drive member comprises a vertical post attached to said drive means and extending therefrom through said slotted aperture.

8. An apparatus according to claim 7 wherein said second means comprises a harness removably firmly attached to and encircling the patient's wrist and a pair of reins interconnecting said harness and said post, and wherein attachment means is provided to connect said reins to said post at different heights, whereby to simultaneously effect both a longitudinal pull and torsion in said reins as said post is driven to a location remote from said support member.

9. An apparatus according to claim 8 wherein each rein is attached to said post by a threaded clamping member, each threaded member and rein being vertically adjustable relative to said post independently of the other.

10. An apparatus according to claim 8 wherein a horizontal cross-bar is centrally pivotally mounted to said post generally at the level of said support member and wherein said reins are connected to opposing ends of said cross-bar, and releasable lock means for positioning said cross-bar either perpendicularly or angularly in either direction relatively to the cross-bar, perpendicular positioning effecting a non-rotational pull on said harness and angular positioning effecting both said pull and torsion in said harness in a direction toward the lowest end of said cross-bar.

11. An apparatus according to claim 10 wherein a pair of stop pins are provided in said cross-bar spaced from each side of said post, said stop pins being engageable with said post when said cross-bar is positioned angularly in either direction so as to limit the extent of angular movement of the cross-bar.

12. A passive motion wrist exercise machine comprising:

a frame having an upper surface with an opening in said upper surface;

horizontal shafts fixed to said frame;

a pneumatic cylinder having a piston;

a carriage connected to said piston for movement therewith, a portion of said carriage extending through said opening in the frame;

an angled arm support means adjustably mounted to said frame, said arm support means having a first surface upon which a user's forearm may rest and a second support surface located distally from the carriage and oriented at an angle to the first support surface so as to support a user's upper arm;

a first securement means connected to the arm support means and suitable for securing a user's arm to the arm support means;

a second securement means for securing a user's wrist to said carriage and for applying traction passively and directly to a user's wrist, said second securement means being attached to said carriage;

an air compressor connected to the pneumatic cylinder and actuating its piston to impart horizontal motion to the carriage which in turn exerts traction on the wrist along the longitudinal axis of the forearm; and a control means for controlling the motion of the carriage.

13. A passive motion wrist exercise machine comprising:

a frame having an upper surface with an opening in said upper surface;

carriage support means fixed to said frame;

a motive means:

a carriage connected to said motive means, a portion of said carriage extending through said opening in the frame;

an angled arm support means adjustably mounted to said frame, said arm support means having a first surface upon which a user's forearm may rest and a second support surface located distally from the carriage and oriented at an angle to the first support surface so as to support a user's upper arm;

a first securement means connected to the arm support means and suitable for securing a user's arm to the arm support means;

a second securement means for securing a user's wrist to said carriage and for applying traction passively and directly to a user's wrist, said second securement means being attached to said carriage;

means for actuating the motive means whereby it imparts horizontal motion to the carriage which in turn exerts traction on the wrist along the longitudinal axis of the forearm; and a control means for controlling the motion of the carriage.

14. The device of claim 13 including an intervalometer for actuating said motive means intermittently for predetermined time periods.

15. An apparatus for passively treating a patient for symptoms of carpal tunnel syndrome comprising;

an elongated housing member having a top supporting surface;

a first support member mounted on said supporting surface for supporting the forearm of the patient in a generally horizontal position and the upper arm in a generally vertical position;

means mounted on said first support member for restraining the patient's forearm from movement in a generally rectilinear direction on said first support member;

a drive member positioned on the top supporting surface and adapted for rectilinear movement;

means mounted on the drive member for attaching the wrist of the patient to the drive member and for applying traction passively and directly to the wrist, and drive means engaging the drive member for moving the drive member in a rectilinear direction whereby the wrist is urged to passively move away from the elbow thereby relieving the symptoms of carpal tunnel syndrome.

16. The apparatus of claim 15 in which said drive means includes a pneumatic actuating means engaging said drive member for applying pressure on the drive member for moving the drive member when operated, said apparatus further including control means for controlling the amount of pressure applied to the drive member.

17. The apparatus of claim 15 in which said first support member comprises;

a first supporting surface extending in a generally horizontal direction for supporting the forearm of the patient;

a second supporting surface extending in a direction generally perpendicular to said first supporting surface; and said restraining means is secured to said first and second supporting surfaces for securing the forearm of the patient to the first supporting surface and the elbow of the patient to the second supporting surface.

18. The apparatus of claim 17 in which said restraining means comprises first strap members and in which said attaching means comprises second strap members for attaching the wrist of the patient to the drive member whereby movement of the drive member will exert pressure on the wrist to move away from the elbow.

19. The apparatus of claim 18 in which the second strap members are vertically offset relative to each other to rotate the wrist about the center of the wrist and forearm during movement of the drive member away from the elbow.

20. A therapy device passive for relieving carpal tunnel syndrome pain from the wrist of a patient comprising;

a housing member having a top supporting surface including a slotted portion;

a pair of rail members secured to said top supporting surface adjacent said slotted portion;

a cradle member slidably mounted on said rail members for supporting the forearm and elbow of the patient in a generally horizontal position, said cradle member having side portions for preventing any lateral movement of the forearm and elbow;

first means secured to the cradle member for restraining the elbow from movement in a generally rectilinear direction;

a movable drive member mounted in said slotted portion and extending to a position adjacent said cradle member;

second means secured to said drive member for attaching the wrist of the patient to the drive member and for applying traction passively and directly to the wrist; and actuating means engaging said drive member for moving the drive member in a direction away from the elbow whereby the wrist is passively urged to move away from the elbow thereby relieving the symptoms of carpal tunnel syndrome.

21. The device of claim 20 in which said actuating means includes a pneumatic actuator member engaging said drive member for applying pressure on the drive member for moving the drive member when operated, said apparatus further including control means for controlling the amount of pressure applied to said actuator for moving the drive member under selected constant pressure.

22. The device of claim 21 which further includes a source of air pressure for operating said actuator member, said control means further including intervalometer means for controlling the duration of air pressure applied to said actuator member and a source of regulated air pressure.

23. The device of claim 20 in which said second means comprises a pair of strap members secured to said drive member and to the wrist of the patient for moving the wrist in a rectilinear direction away from the elbow.

24. The device of claim 20 in which said second means comprises a pair of strap members secured to said drive member and to the wrist of the patient, said strap members being vertically offset from each other at the point of attachment to said drive member for effecting rotation of the wrist during movement of the drive member in a rectilinear direction away from the elbow.

* * * * *